US006002208A

United States Patent [19]

Maishev et al.

[11] Patent Number: 6,002,208

[45] Date of Patent: Dec. 14, 1999

[54] UNIVERSAL COLD-CATHODE TYPE ION SOURCE WITH CLOSED-LOOP ELECTRON DRIFTING AND ADJUSTABLE ION-EMITTING SLIT

[75] Inventors: Yuri Maishev, Moscow, Russian Federation; James Ritter, Fremont; Leonid Velikov, San Carlos, both of Calif.

[73] Assignee: Advanced Ion Technology, Inc., Fremont, Calif.

[21] Appl. No.: 09/109,684

[22] Filed: Jul. 2, 1998

[51] Int. Cl.[6] ..... H01J 27/02

[52] U.S. Cl. ..... 315/111.9; 315/111.41; 250/423 R; 250/429.23

[58] Field of Search ..... 315/111.31, 111.41, 315/111.81, 111.91; 250/492.23, 423 R

[56] References Cited

U.S. PATENT DOCUMENTS

| | | | |
|---|---|---|---|
| Re. 30,171 | 12/1979 | Kruger et al. | 250/423 R |
| 4,122,347 | 10/1978 | Kovlasky et al. | 315/111.81 |
| 4,710,283 | 12/1987 | Singh et al. | 315/111.81 X |
| 5,350,920 | 9/1994 | Fukuyama et al. | 250/492.21 X |

FOREIGN PATENT DOCUMENTS 2030807 of 1995 Russian Federation .

*Primary Examiner*—Justin P. Bettendorf
*Attorney, Agent, or Firm*—Ilya Zborovsky

[57] ABSTRACT

A universal cold-cathode type ion source with a closed-loop electron drifting source and with an ion-beam propagation direction perpendicular to the plane of electron drifting is intended for uniformly treating stationary or moveable objects with such processes as cleaning, activation, polishing, thin-film coating, or etching. The ion source of the invention allows adjustment of beam parameters and configurations and has an ion emitting slit of an adjustable geometry. In one embodiment, the adjustment is carried out by changing the width of the slit by shifting moveable parts of the cathode in the direction perpendicular to the direction of the ion beam. In another embodiment the slit configuration is adjusted by shifting a moveable part of the cathode in the direction of the beam propagation. The invention also provides a method for adjusting the shape and configuration of the ion beam with respect to the object to be treated. The adjustment can be performed during the operation of the ion beam while observing the beam through a sealed transparent window of the vacuum chamber.

18 Claims, 7 Drawing Sheets

UNIVERSAL COLD-CATHODE TYPE ION SOURCE WITH CLOSED-LOOP ELECTRON DRIFTING AND ADJUSTABLE ION-EMITTING SLIT

FIELD OF THE INVENTION

The present invention relates to ion-emission technique, particularly to cold-cathode ion sources used for cleaning, activation, polishing, or thin-film coating of surfaces. More specifically, the invention relates to a universal cold-cathode type ion source with ion-beam propagation direction perpendicular to the plane of electron drifting. The source is intended for treating objects of different configurations and with large surface areas.

BACKGROUND OF THE INVENTION AND DESCRIPTION OF THE PRIOR ART

An ion source is a device that ionizes gas molecules and then focuses, accelerates, and emits them as a narrow beam. This beam is then used for various technical and technological purposes such as cleaning, activation, polishing, thin-film coating, or etching.

An example of an ion source is the so-called Kaufman ion source, also known as a Kaufman ion engine or an electron-bombardment ion source described by Kaufman H. R. in: An ion Rocket with an Electron-Bombardment Ion Source, NASA Technical Note, TND-585, January 1961.

This ion source consists of a discharge chamber in which a plasma is formed, and an ion-optical system which generates and accelerates an ion beam to an appropriate level of energy. A working medium is supplied to the discharge chamber which contains a hot cathode that functions as a source of electrons and is used for firing and maintaining a gas discharge. The plasma, which is formed in the discharge chamber, acts as an emitter of ions and creates, in the vicinity of the ion-optical system, an ion-emitting surface. As a result, the ion-optical system extracts ions from the aforementioned ion-emitting surface, accelerates them to a required energy level, and forms an ion beam of a required configuration. Typically, aforementioned ion sources utilize two-grid or three-grid ion-optical systems. A disadvantage of such a device is that it is not suitable for treating large surfaces. Another disadvantage is that the ion beam has low intensity.

Attempts have been made to provide ion sources with ion beams of higher intensity by holding the electrons in a closed space between a cathode and an anode where the electrons could be held. For example, U.S. Pat. No. 4,122,347 issued in 1978 to Kovalsky et al. describes an ion source with a closed-loop of electrons for ion-beam etching and deposition of thin films, wherein the ions are taken from the boundaries of a plasma formed in a gas-discharge chamber with a hot cathode. The ion beam is intensified by a flow of electrons which is held in crossed electrical and magnetic fields within the accelerating space and which compensates for the positive spatial charge of the ion beam.

A disadvantage of the devices of such type is that it does not allow formation of ion beams of chemically-active substances for ion beams capable of treating large surface areas. Other disadvantages of the aforementioned device are short service life and high non-uniformity of ion beams.

U.S. Pat. No. 4,710,283 issued in 1997 to Singh et al. describes a cold-cathode type ion source with crossed electric and magnetic fields for ionization of a working substance wherein entrapment of electrons and generation of the ion beam are performed with the use of a grid-like electrode. This source is advantageous in that it forms belt-like and tubular ion beams emitted in one or two opposite directions.

However, the ion source with a grid-like electrode of the type disclosed in U.S. Pat. No. 4,710,283 has a number of disadvantages consisting in that the grid-like electrode makes it difficult to produce an extended ion beam and in that the ion beam is additionally contaminated as a result of sputtering of the material from the surface of the grid-like electrode. Furthermore, with the lapse of time the grid-like electrode is deformed whereby the service life of the ion source as a whole is shortened.

Other publications (e.g., Kaufman H. R. et al. (End Hall Ion Source, J. Vac. Sci. Technol., Vol. 5, July/August, 1987, pp. 2081–2084; Wykoff C. A. et al., 50-cm Linear Gridless Source, Eighth International Vacuum Web Coating Conference, Nov. 6–8, 1994)) disclose an ion source that forms conical or belt-like ion beams in crossed electrical and magnetic fields. The device consists of a cathode, a hollow anode with a conical opening, a system for the supply of a working gas, a magnetic system, a source of electric supply, and a source of electrons with a hot cathode. A disadvantage of this device is that it requires the use of a source of electrons with a hot or hollow cathode and that it has electrons of low energy level in the zone of ionization of the working substance. These features create limitations for using chemically-active working substances. Furthermore, a ratio of the emission slit width to a cathode-anode distance is significantly greater than 1, and this decreases the energy of electrons in the charge gap, and hence, hinders ionization of the working substance. Configuration of the electrodes used in the ion beam of such sources leads to a significant divergence of the ion beam. As a result, the electron beam cannot be delivered to a distant object and is to a greater degree subject to contamination with the material of the electrode. In other words, the device described in the aforementioned literature is extremely limited in its capacity to create an extended uniform belt-like ion beam. For example, at a distance of 36 cm from the point of emission, the beam uniformity did not exceed ±7%.

Russian Patent No. 2,030,807 issued in 1995 to M. Parfenyonok, et al. describes an ion source that comprises a magnetoconductive housing used as a cathode having an ion-emitting slit, an anode arranged in the housing symmetrically with respect to the emitting slit, a magnetomotance source, a working gas supply system, and a source of electric power supply.

FIGS. 1 and 2 schematically illustrate the aforementioned known ion source with a circular ion-beam emission slit. More specifically, FIG. 1 is a sectional side view of an ion-beam source with a circular ion-beam emission slit, and FIG. 2 is a sectional plan view along line II—II of FIG. 1.

The ion source of FIGS. 1 and 2 has a hollow cylindrical housing 40 made of a magnetoconductive material such as Armco steel (a type of a mild steel), which is used as a cathode. Cathode 40 has a cylindrical side wall 42, a closed flat bottom 44 and a flat top side 46 with a circular ion emitting slit 52 having dimensions defined by its inner profile 52*a* and an outer profile 52*b*.

A working gas supply hole 53 is formed in flat bottom 44. Flat top side 46 functions as an accelerating electrode. Placed inside the interior of hollow cylindrical housing 40 between bottom 44 and top side 46 is a magnetic system which includes a cylindrical or oval permanent magnet 66 with poles N and S of opposite polarity. An N-pole faces flat top side 46 and S-pole faces bottom side 44 of the ion source. The purpose of the magnetic system with a closed magnetic circuit formed by parts 66, 40, 42, and 44 is to induce a magnetic field in ion emission slit 52. It is understood that this magnetic system is shown only as an example and that it can be formed in a manner described, e.g., in aforementioned U.S. Pat. No. 4,122,347. A circular annular-shaped anode 54 which is connected to a positive pole 56*a* of an electric power source 56 is arranged in the interior of housing 40 around magnet 66 and concentric thereto. Anode 54 is fixed inside housing 40 by means of a ring 48 made of non-magnetic dielectric material such as ceramic. Anode 54 has a central opening 55 in which aforementioned permanent magnet 66 is installed with a gap between the outer surface of the magnet and the inner wall of opening 55. A negative pole 56*b* of electric power source is connected to housing 40 which is grounded at GR.

Located above housing 40 of the ion source of FIGS. 1 and 2 is a sealed vacuum chamber 57 which has an evacuation port 59 connected to a source of vacuum (not shown). An object OB to be treated is supported within chamber 57 above ion emitting slit 52, e.g., by gluing it to an insulator block 61 rigidly attached to the housing of vacuum chamber 57 by a bolt 63 but so that object OB remains electrically and magnetically isolated from the housing of vacuum chamber 57. However, object OB is electrically connected via a line 56*c* to negative pole 56*b* of power source 56. Since the interior of housing 40 communicates with the interior of vacuum chamber 57, all lines that electrically connect power source 56 with anode 54 and object OB should pass into the interior of housing 40 and vacuum chamber 57 via conventional commercially-produced electrical feedthrough devices which allow electrical connections with parts and mechanisms of sealed chambers without violation of their sealing conditions. In FIG. 1, these feedthrough devices are shown schematically and designated by reference numerals 40*a* and 57*a*. Reference numeral 57*b* designates a seal for sealing connection of vacuum chamber 57 to housing 40.

The known ion source of the type shown in FIGS. 1 and 2 is intended for the formation of a unilaterally directed tubular ion beam. The source of FIGS. 1 and 2 forms a tubular ion beam IB emitted in the direction of arrow A and operates as follows.

Vacuum chamber 57 is evacuated, and a working gas is fed into the interior of housing 40 of the ion source. A magnetic field is generated by magnet 66 in the accelerating gap between anode 54 and cathode 40, whereby electrons begin to drift in a closed path within the crossed electrical and magnetic fields. A plasma 58 is formed between anode 54 and cathode 40. When the working gas is passed through the ionization gap, tubular ion beam IB, which is propagated in the axial direction of the ion source shown by an arrow A, is formed in the area of an emission slit 52 and in an accelerating gap 52*a* between anode 54 and cathode 40.

The diameter of the tubular ion beam formed by means of such an ion source may reach 500 mm and more.

The ion source of the type shown in FIG. 1 is not limited to a cylindrical configuration and may have an elliptical or an oval-shaped cross section as shown in FIG. 3. In this case the respective parts, i.e., side walls of the cathode $\mathbf{40}_{ov}$, a magnet $\mathbf{66}_{ov}$, and an anode $\mathbf{54}_{ov}$ will have an-oval shaped cross-section shown in FIG. 3 and will form an oval-shaped ion-emiting slit $\mathbf{52}_{ov}$. In FIG. 3 the parts of the ion beam source that correspond to similar parts of the previous embodiment are designated by the same reference numerals with an addition of subscript OV. Structurally, this ion source is the same as the one shown in FIG. 1 with the exception that a cathode $\mathbf{40}_{ov}$, anode $\mathbf{54}_{ov}$, a magnet $\mathbf{66}_{ov}$ and hence an emitting slit (not shown in FIG. 3), have an oval-shaped configuration. As a result, a belt-like ion beam having a width of up to 1400 mm can be formed. Such an ion beam source is suitable for treating large-surface objects when these objects are passed over ion beam IB emitted through emitting slit 52.

With 1 to 3 kV voltage on the anode and various working gases, this source makes it possible to obtain ion beams with currents of 0.5 to 1 A. In this case, an average ion energy is within 400 to 1500 eV, and a nonuniformity of treatment over the entire width of a 1400 mm-wide object does not exceed ±5%.

Nevertheless, the aforementioned belt-type ion source has limited dimensions and is unsuitable for uniformly treating stationary objects of large surface areas. Furthermore, it does not allow simultaneous treatment of an object from different sides with a plurality of beams controlled simultaneously or individually. It cannot form extended ion beams of different configurations, such as converging or diverging ion beams, nor can it form several ion beams at the same time, and does not allow adjustment of ion beams to form beams of different configurations.

OBJECTS OF THE INVENTION

It is an object of the invention to provide an ion source with a closed-loop configuration of the ion emitting slit which allows adjustment of geometrical dimensions of the ion emitting slit.

Another object is to provide an ion source of the aforementioned type which may produce ion beams of different configurations.

Another object of the invention is to provide an ion source of the aforementioned type which allows treatment of objects with different surface areas.

Another object is to provide an ion beam source of the aforementioned type which allows adjustment of an average energy of ions in the beam.

Another object is to provide an ion beam source of the aforementioned type which allows adjustment of the composition of the ion beam, in case of a multiple-component gas used as a working medium.

SUMMARY OF THE INVENTION

A universal cold-cathode type ion source with closed-loop electron drifting and with ion-beam propagation direction perpendicular to the plane of electron drifting is intended for uniformly treating stationary or moveable objects with such processes as cleaning, activation, polishing, thin-film coating, or etching. The ion source of the invention allows for adjusting beam parameters and configurations and has an ion emitting slit of an adjustable geometry. In one embodiment, the adjustment is carried out by changing the width of the slit by shifting moveable parts of the cathode in the direction perpendicular to the direction of the ion beam. In another embodiment the slit configuration is adjusted by shifting a moveable part of the cathode in the direction of the beam propagation.

DETAILED DESCRIPTION OF THE INVENTION

Figure 4:
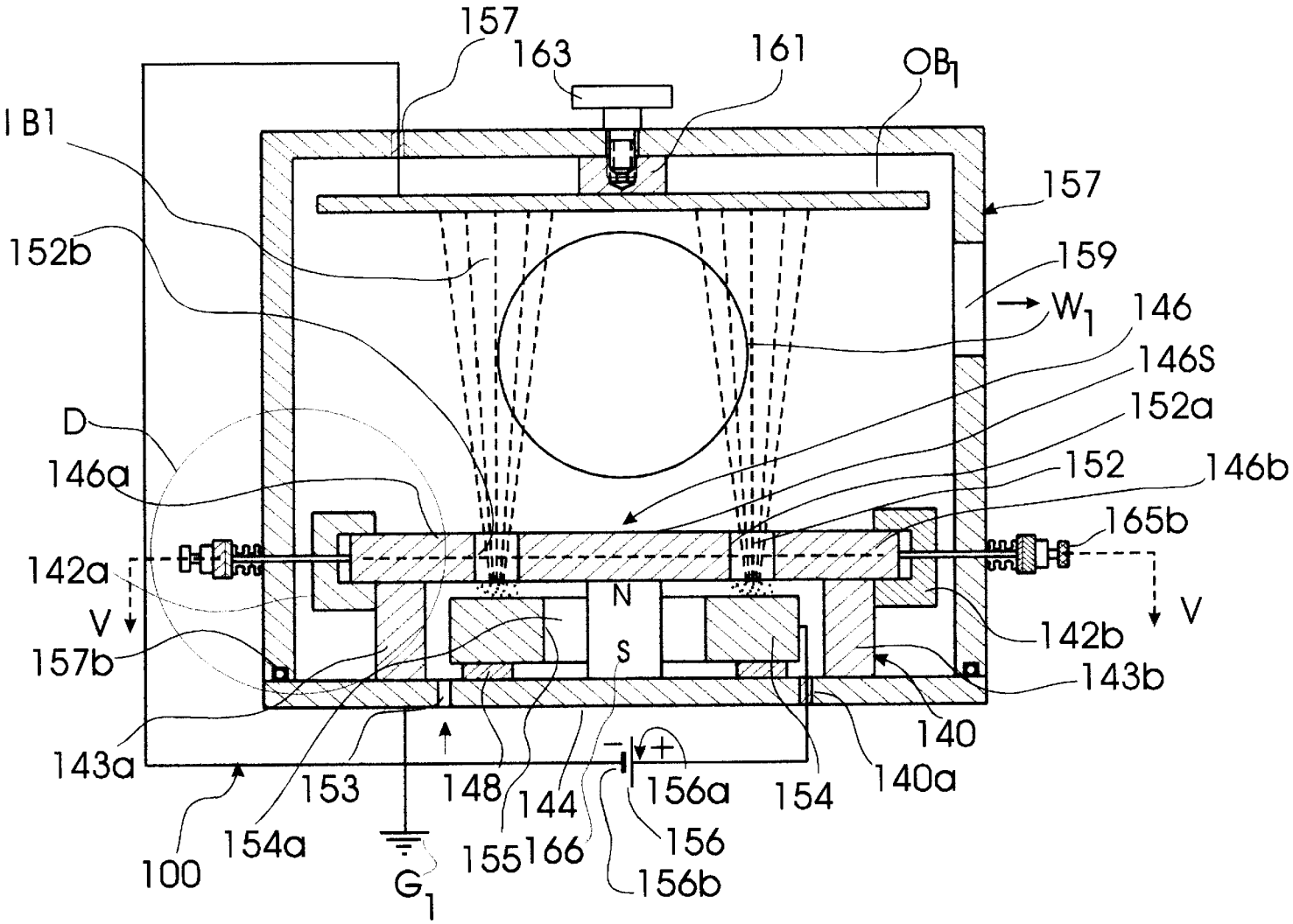
FIG. 4 is a sectional side view along the line IV—IV of FIG. 5 illustrating an ion-beam source according to an embodiment of the invention with an emitting-slit width adjustable by shifting moveable parts of the cathode in the direction perpendicular to the direction of the ion beam.
Figure 4A:
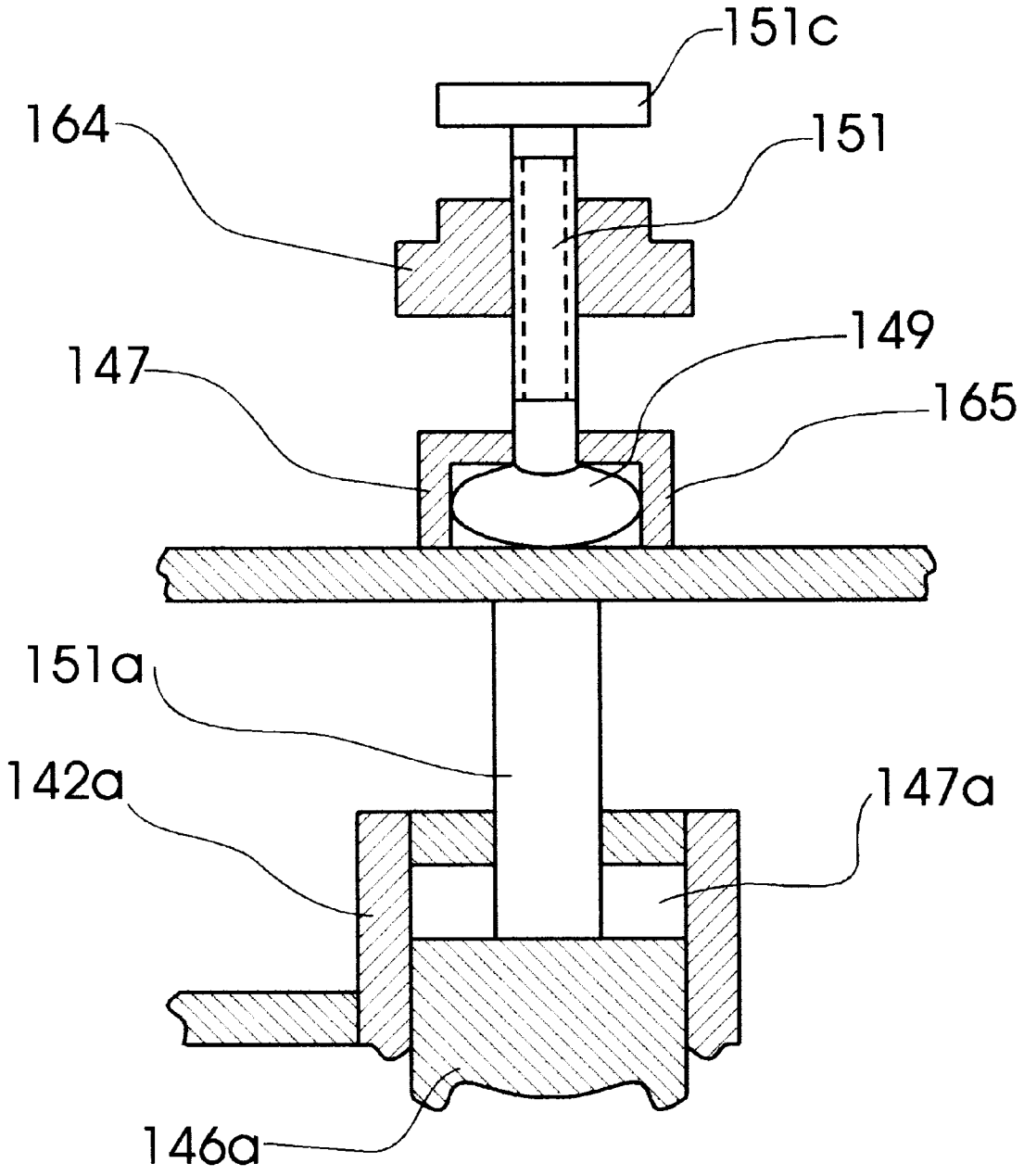
FIG. 4*a* is a zone D of FIG. 4 shown on a larger scale.
Figure 5:
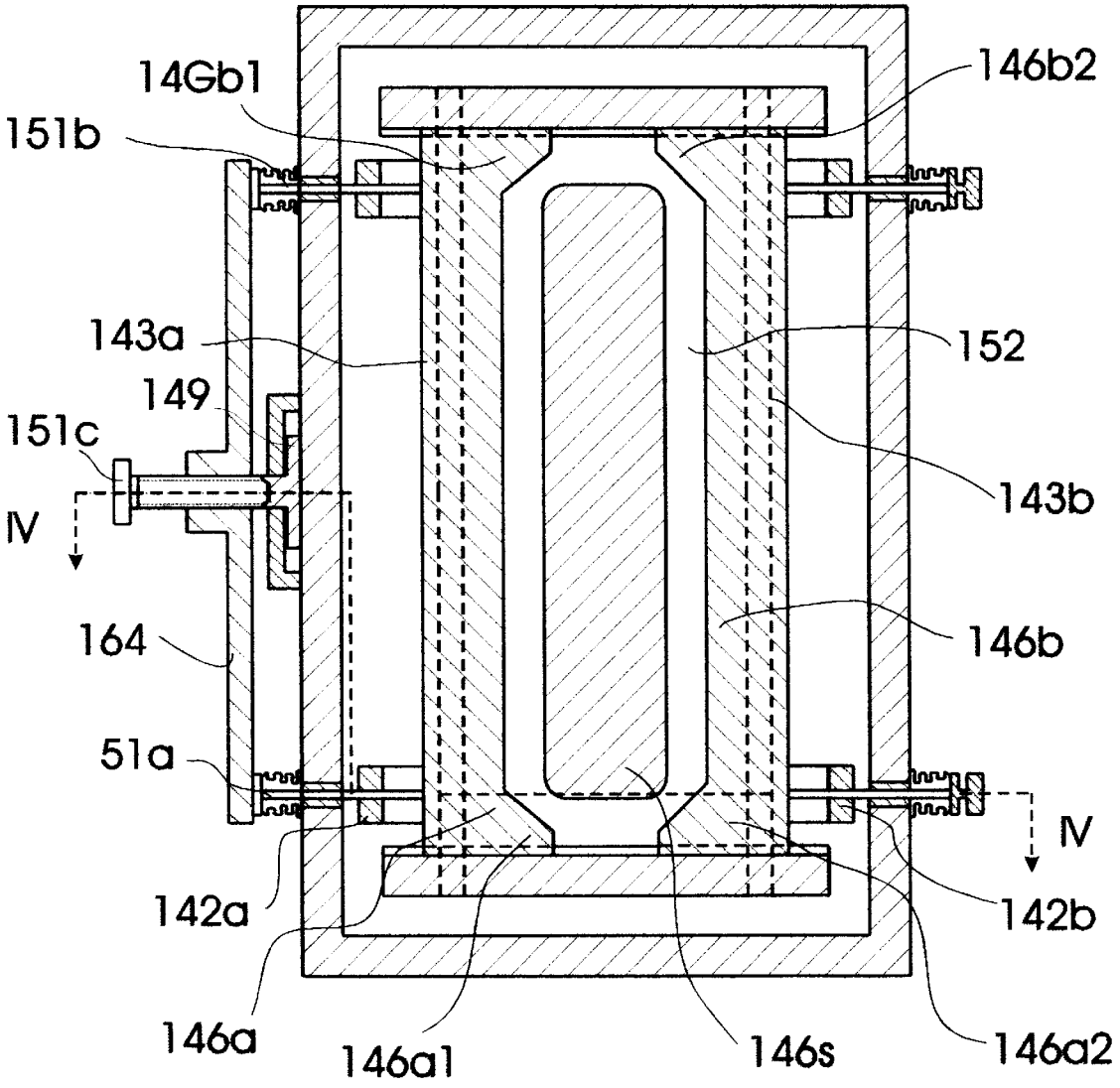
FIG. 5 is a sectional view along line V—V of FIG. 4.

FIGS. 4, 4A, and 5—Ion Source with Adjustable Width of the Emitting Slit

FIG. 4 is a sectional side view along the line IV—IV of FIG. 5 illustrating an ion-beam source according to one embodiment of the invention in which the width of an ion-emitting-slit is adjustable by shifting moveable parts of the cathode of the source in the direction perpendicular to the direction of the ion beam emitted by the source. FIG. 5 is a sectional view along line V—V of FIG. 4.

To some extent, an ion-beam source 100 of this embodiment is similar to the known ion source with a circular ion-beam emission slit of the type shown and described in connection with FIGS. 1, 2, and 3. The parts and units of ion-beam source 100 similar to those of FIGS. 1 through 3 will be designated by the same reference numerals with an addition of 100. Thus, ion source 100 has a hollow cylindrical housing 140 made of a magnetoconductive material such as Armco steel which is used as a cathode. As shown in FIG. 5 by broken lines, in the illustrated embodiment housing 140 has a substantially rectangular top-view configuration with side walls 143*a*, 143*b*, a closed flat bottom 144 (FIG. 4) and a flat top side 146 with a closed-loop ion emitting slit 152. This slit has predetermined shape and geometric dimensions defined by its inner profile 152*a* and an outer profile 152*b*. It is understood that the oval shape is shown in FIG. 5 only as an example and that the slit, as well as the cathode, anode, and permanent magnet may be of any required configuration such as circular, rectangular, elliptic, etc.

A working gas supply hole 153 is formed in bottom wall 144. Flat top side 146 functions as an accelerating electrode. Placed inside the interior of hollow cylindrical housing 140 between bottom 144 and top side 146 is a magnetic system which includes a permanent magnet 166 with poles N and S of opposite polarity. The N-pole faces flat top side 146 and the S-pole faces bottom side 144 of the ion source. The purpose of the magnetic system with a closed magnetic circuit formed by parts 166, 146, 152, 143, and 144 is to induce a magnetic field in ion emission slit 152. It is understood that this magnetic system is shown only as an example and that it can be formed in a different manner, e.g., as in aforementioned U.S. Pat. No. 4,122,347. A closed-loop anode 154 which is connected to a positive pole 156*a* of an electric power source 156 is arranged in the interior of housing 140 around magnet 166 and concentrically thereto. Anode 154 is fixed inside housing 140 by means of an annular body 148 of the same top-view configuration as the anode. Body 148 is made of nonmagnetic dielectric material such as ceramic. Anode 154 has a central opening 155 in which a permanent magnet 166 is installed with a gap 154*a* between the outer surface of the magnet and the inner wall of opening 155. A negative pole 156*b* of electric power source is connected to housing 140 which is grounded at $G_1$.

Located above housing 140 of the ion source of FIGS. 4 is a sealed vacuum chamber 157 which has an evacuation port 159 connected to a source of vacuum (not shown). An object $OB_1$ to be treated is supported within chamber 157 above ion emitting slit 152, e.g., by gluing it to an insulator block 161 rigidly attached to the housing of vacuum chamber 157 by a bolt 163 but so that object $OB_1$ remains electrically and magnetically isolated from the housing of vacuum chamber 157. However, object $OB_1$ is electrically connected via a line 159 to negative pole 156*b* of power source 156. Since the interior of housing 140 communicates with the interior of vacuum chamber 157, all lines that electrically connect power source 156 with anode 154 and object $OB_1$ should pass into the interior of housing 140 and vacuum chamber 157 via conventional commercially-produced electrical feedthrough devices. In FIG. 4, these feedthrough devices are shown schematically and designated by reference numerals 140*a* and 157*a*. Reference numeral 157*b* designates a seal for sealing connection of vacuum chamber 157 to housing 140.

An ion beam is visible in the form of a strand of light so that its shape and position with respect to the surface of object $OB_1$ can be observed during the operation of the ion source. To view this, vacuum chamber 157 has a transparent sealed window W1 in one of its walls.

Figure 1:
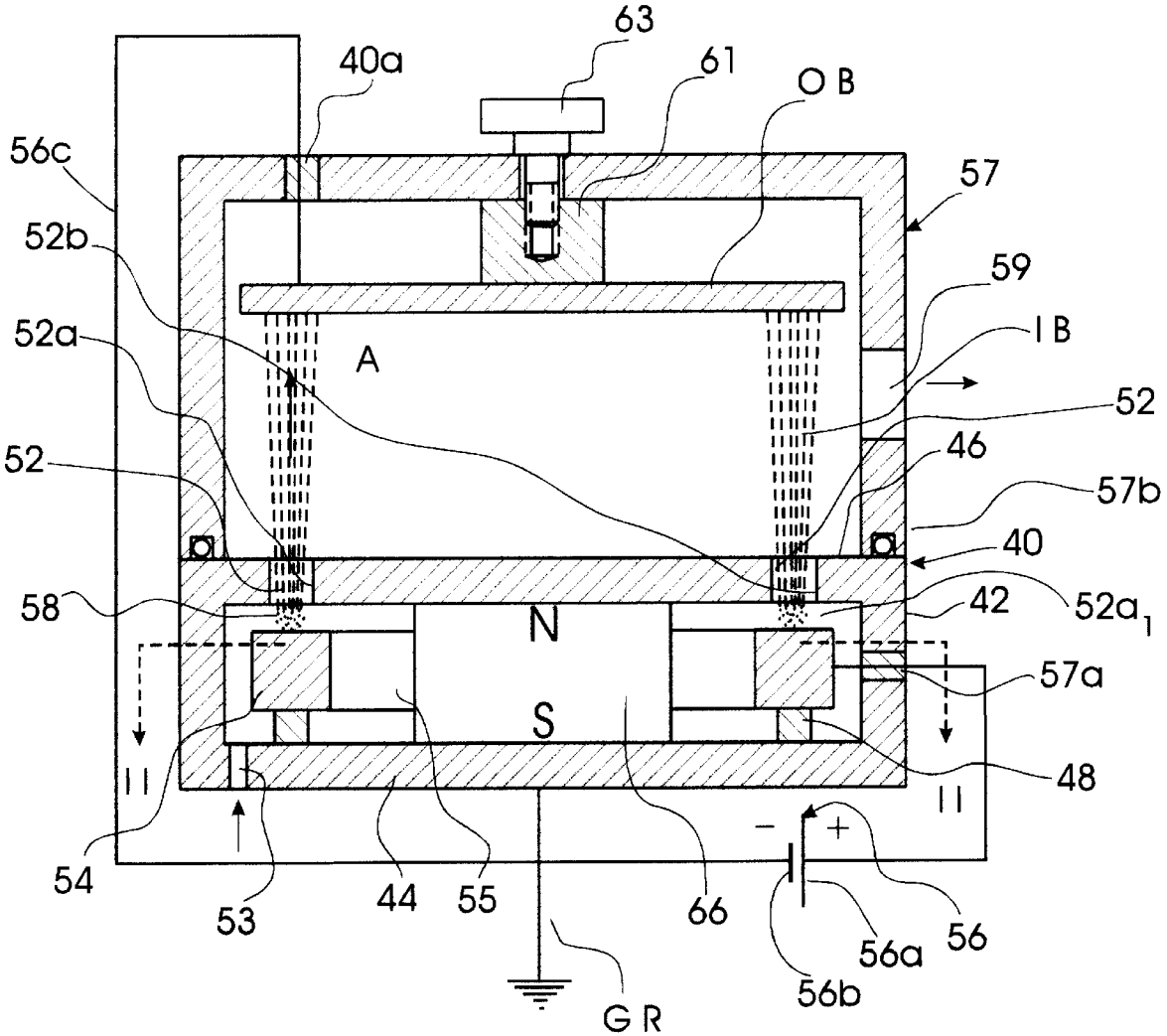
FIG.1 PRIOR ART
FIG. 1 is a sectional side view of a known ion-beam source with a circular ion-beam emission slit.

To this point, the apparatus of FIG. 4 is identical to that of FIG. 1. However, an essential distinctive feature of ion-beam source 100 of FIG. 4 is that its cathode 140 has a stationary portion 146S and moveable portions 146*a* and 146*b* which are located on opposite sides of upper wall 146 and are guided in guides 142*a* and 142*b* rigidly attached to or made integrally with side walls 143*a* and 143*b* of cathode 140.

FIG. 4A shows zone D of FIG. 4 that illustrates details of slit width adjustment mechanisms on a larger scale. Although only one mechanism is shown, the reference numerals relate to left-hand and right-hand mechanisms as they are identical. Cathode portions 142*a* and 142*b* have recesses 147*a* and 147*b* that receive rods 151*a*, 151*b*. One end of each rod 151*a* and 151*b* is rigidly connected to moveable part 146*a*, 146*b* of cathode 140. Other ends of rods 151*a*, 151*b* pass via the wall of vacuum chamber 157 and via feedthrough 162*a*, 162*b* and are attached to a cross bar 164 (FIG. 5). Cross bar 164 has a threaded opening 164*a*. A bolt 151 is threaded into opening 164*a*. The end of bolt 151 opposite to its head 151*c*, which is used as a handle, has a collar 149 which freely rotates in a recess 147 made in the housing of vacuum chamber 157 or, as shown in FIGS. 4*a* and 5, is formed by a cup-shaped body 165 attached to the vacuum chamber housing.

Feedthrough devices 162*a* and 162*b* are commercially produced units known as manual linear feedthrough mechanisms. Such devices are made in the form of bellows and are produced, e.g., by Huntington Mechanical Laboratories, Inc. In the present embodiment of the invention, bellows 162*a*, 162*b* are sealingly connected at one end to the outer surface of the vacuum chamber housing and at the other end to the surface of cross bar 164. Thus moveable parts 146*a* and 146*b* can be moved linearly by rotating handle 151*c* from the outside of the vacuum chamber without violation of vacuum in the vacuum chamber.

As shown in FIG. 5, inner ends 146*a*1, 146*a*2 and 146*b*1, 146*b*2 of respective moveable portions 146*a* and 146*b* of cathode 140 have triangular configuration in order to conform to an oval-shaped stationary part 146S. This allows for maintaining the thickness of ion-emitting slit 152 substantially uniform all over the perimeter of the slit.

Figure 2:
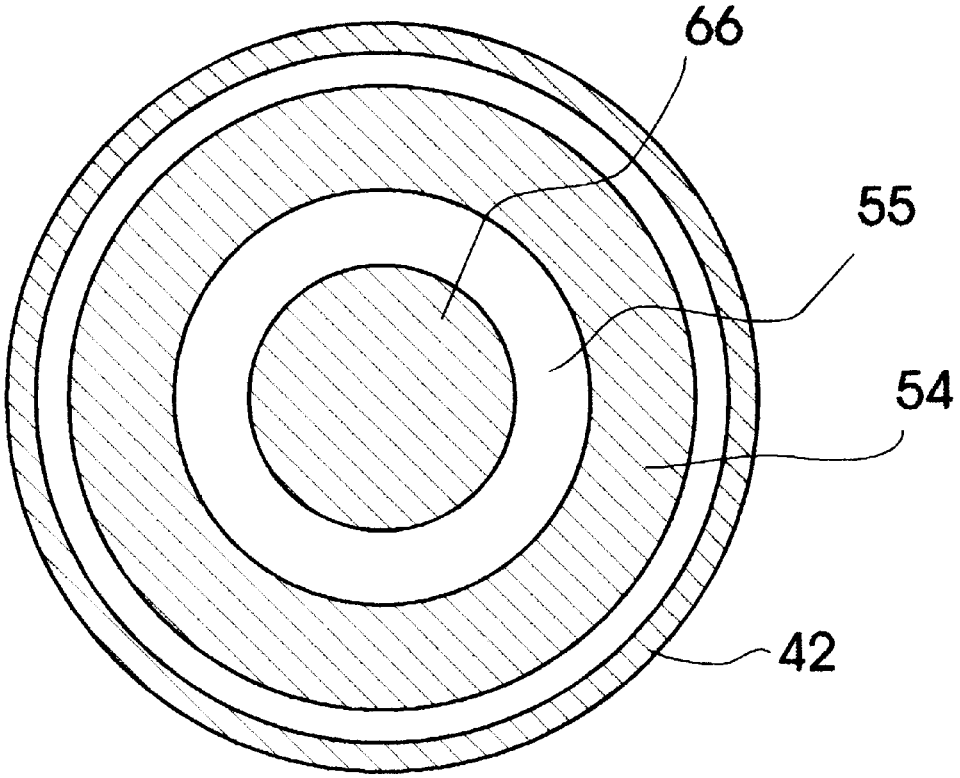
FIG. 2. PRIOR ART
FIG. 2 is a sectional plan view along line II—II of FIG. 1.
Figure 3:
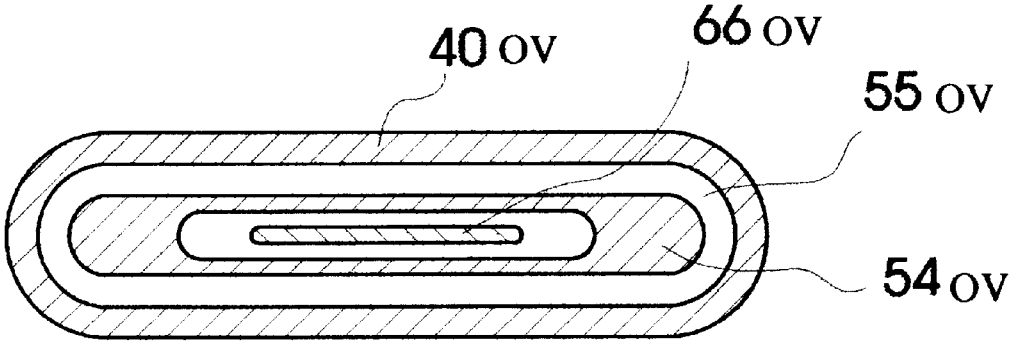
FIG. 3. PRIOR ART
FIG. 3 is a sectional plan view similar to the one of FIG. 2, but with an oval-shaped sectional configuration of the ion-emitting slit.

Unless the width of slit 152 is adjusted, the closed-loop slit has predetermined geometric dimensions, and operation of ion source 100 is the same as that of the ion source of FIGS. 1 through 3. Therefore the detailed operation of ion source 100 will be omitted.

When it is necessary to adjust the width of closed-loop ion-emitting slit 152, handle 151*c* is rotated in a counter-clockwise or clockwise direction, depending on whether slit 152 is to be expanded or narrowed. As handle 151*c* rotates, the threaded portion of bolt 151 engages the threaded opening of cross bar 164. Since head 149 can rotate in recess 147 but cannot move in the direction of the axis of bolt 151, cross bar 164 and hence rods 151*a* and 151*b* begin to move. As rods 151*a* and 151*b* are rigidly connected to moveable parts 146*a* and 146*b* of the cathode, the latter are shifted, with respect to stationary part 146S of the cathode, toward each other or in opposite direction, depending on the direction of rotation of handle 151*c*.

When the width of ion-emitting slit is increased, the oval-shaped beam IB1 is diverged and covers a larger area of the object being treated. When the width of the ion-emitting slit is decreased, the oval-shaped beam IB1 is converged and covers a smaller area of object $OB_1$. The convergence and divergence of ion beams change its shape and thus the nature of treatment (cleaning, etching, or coating). The apparatus of the invention allows adjustment during the operation of the source, so that shape of ion beam IB1 and its location with respect to object OB1 may be observed through transparent sealed window W1.

Another feature of ion source 100 with an adjustable slit width is that it allows to adjust an average energy of ions on the beam. When the slit width is decreased, the ionization zone approaches the anode surface, and the average ion energy increases. Furthermore, ion source 100 allows adjustment of energy of electrons and thus of the composition of the ion beam, in case of a multiple-component gas used as a working medium. This feature ensures selectivity of the process, e.g., in reactive ion-beam etching.

Figure 6:
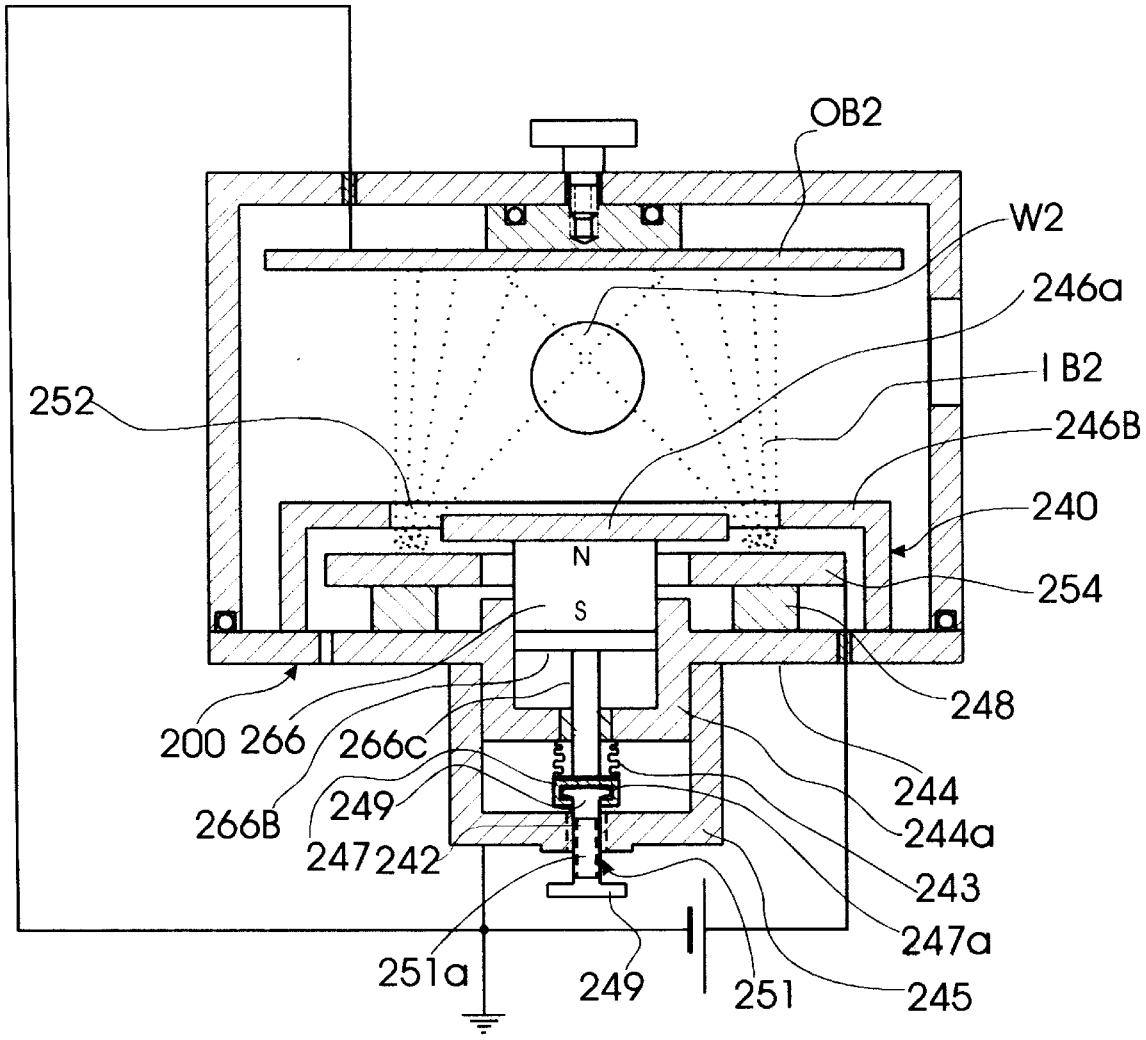
FIG. 6 is a sectional side view of an ion-beam source according to another embodiment of the invention with an emitting slit configuration adjustable by shifting a moveable part of the cathode in the direction of the beam propagation.
Figure 6A:
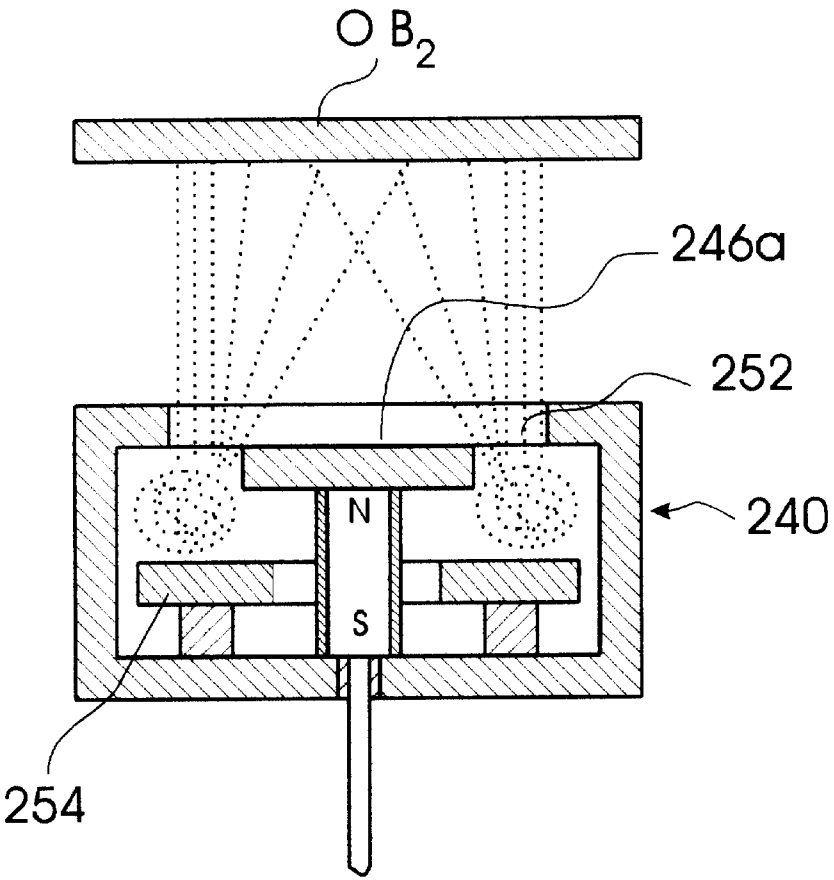
FIG. 6A shows the position of moveable portion of the adjustable cathode which provides the converging shape of the ion beam.
Figure 6B:
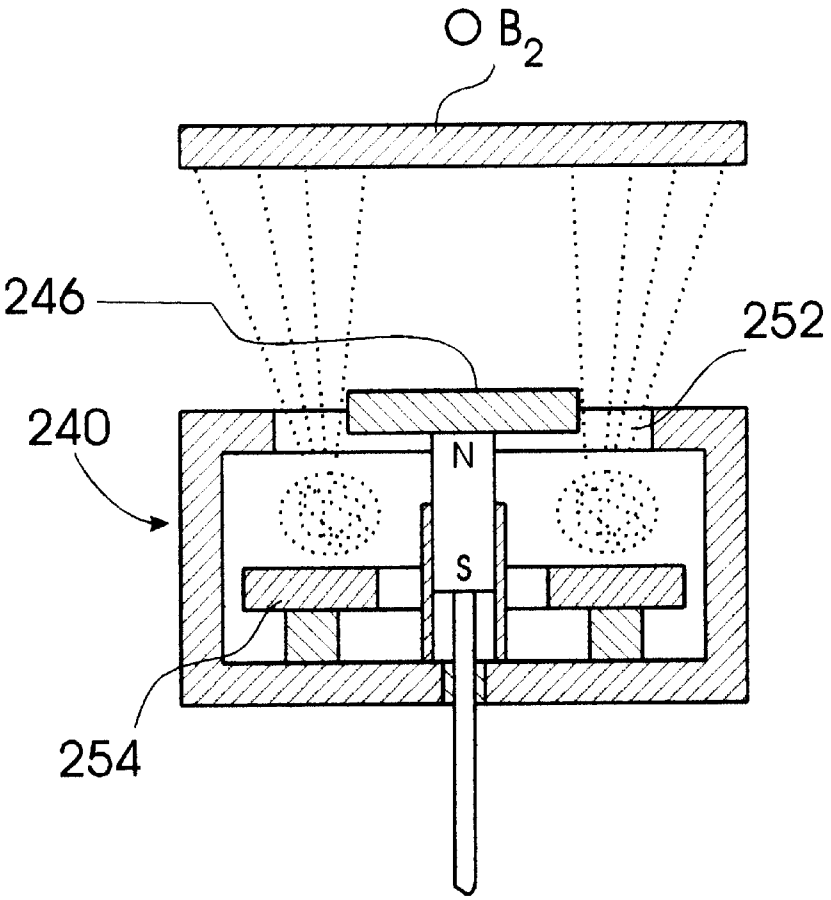
FIG. 6B shows the position of moveable portion of the adjustable cathode which provides the diverging shape of the ion beam.

FIGS. 6, 6A, and 6B—Ion-Beam Source with Part of Cathode Moveable in the Beam-Propagation Direction FIG. 6 is a sectional side view of an ion-beam source according to another embodiment of the invention with an ion-emitting slit configuration adjustable by shifting a moveable part of the cathode in the direction of the beam propagation.

To some extent, the ion-beam source of this embodiment, which as a whole is designated by reference numeral 200, is similar to ion source 100 of the embodiment shown and described with reference to FIGS. 4 and 5. Therefore, the parts and units of ion-beam source 200 similar to those of FIGS. 4 and 5 will be designated by the same reference numerals with an addition of 100 to designations of FIGS. 4 and 5. The description of identical parts will be omitted.

In this ion beam source, a central portion 246*a* of a cathode 246 is moveable together with a magnet 266 relative to the remaining stationary portion 246*b* of the cathode. In the example, illustrated in FIG. 6, ion-emitting slit 252 is formed between moveable portion 246*a* and stationary portion 246*b* of cathode 246 which, in turn, form a housing 240 of ion source 200. In the illustrated embodiment, surfaces of portions 246*a* and 246*b* that face object OB2 are flat and parallel to each other. Magnet 266 is rigidly attached at its N pole, e.g., by screws (not shown), to a moveable portion 246*a*. Attached to S-pole side of magnet 266 is a magneto-conductive piston portion 266*b*. Lower wall 244 of housing 240 has a guide portion 244*a* for guiding the end of magnet 266 with piston portion 246*b* in the direction of propagation of a beam IB2. Movement is carried out with the use of a mechanism similar to the one shown in FIG. 4A. More specifically, a bolt 251 has a threaded portion 251*a* engageable with a threaded opening 242 in the lower part 245 of the housing. A head 249 of the bolt is placed in a recess 247*a* of a block 247 with possibility of rotation with respect thereto. Block 247 is rigidly attached to the end of a rod 266*c* of piston 266*b*. Rod 266*c* via a feedthrough 243*a* into lower part 245 of the housing. The end of bolt 251 opposite to piston 266*b* passes outside part 245 of the housing and supports a handle 249. An anode 254 is supported in housing 240 by a block 248 of a nonmagnetic material.

Similar to the embodiment of FIGS. 4 and 5, the apparatus of FIG. 6 has a transparent sealed window W2 in the wall of a vacuum chamber 257.

For adjusting operation conditions of ion source 200, moveable portion 246*a* can be displaced to a required position with respect to the stationary portion of housing 240, thus changing the configuration and performance characteristics of ion-emitting slit 252. More specifically, as shown in FIGS. 6A and 6B, which illustrate configurations of ion beam at different position of moveable portion 246*a*, when the upper surface of moveable portion 246*a* of the cathode is below the surface of stationary portion 246*b* (FIG. 6A), ion beam 252 has a converging configuration, and when the upper plane of moveable portion 246 of the cathode is above the plane of stationary portion 246*b* (FIG. 6B), ion beam 252 has a diverging configuration.

Thus it has been shown that the present invention provides a universal cold-cathode type ion source with closed-loop electron drifting which allows formation of ion beams of chemically-active substances for treating stationary objects with large surface areas, has an extended service life, provides ion beams of high uniformity, allows the use of a wide range of chemically-active working media, provides an increased energy of ions produced in the charge gap which allows treatment of distantly located objects, provides an ion source of the aforementioned type suitable for simultaneous treatment of objects from different sides with a plurality of selectively controlled ion beams, and allows adjustment of an ion beam to form ion beams of different configurations.

Although the invention has been shown in the form of specific embodiments, it is understood that these embodiments were given only as examples and that any changes and modifications are possible, provided they do not depart from the scope of the appended claims. For example, the cathode housings of ion sources, as well as ion emitting slits, and anodes may have configurations other than rectangular, circular, oval, or elliptic. Moveable parts of cathodes can be displaced with the use of different mechanisms such as a mechanism for synchronous movement of both moveable parts of the cathode. Anodes may be secured inside cathode housings to a block of nonmagnetic materials by fasteners, press fits, glues, etc. The objects to be treated may be fixed by bolts which, at the same time, may be used for grounding the objects. Working media may comprise different gases or their combinations. The objects to be treated may be different in shape and dimensions and may be subjected to different sequence of treatment. In the embodiment with a part of the anode moveable in the direction of beam propagation the permanent magnet is shown rigidly attached to the moveable anode part. It is understood that the magnet may remain stationary and the anode part may move alone.

What we claim is:

1. A universal ion beam source with a closed-loop ion-emitting slit capable of emitting an ion beam toward an object located in a position reachable by said ion beam, comprising:

a hollow housing that functions as a cathode of said ion beam source;

an anode located in said hollow housing and spaced from said cathode to form an ionization gap therebetween for ionization and acceleration of ions formed in said gap during operation of said ion beam source, magnetic field generating means in magnetoconductive relationship with said anode and said cathode for forming closed magnetoconductive circuit passing through said anode, said ionization gap, said cathode, and said magnetic field generating means;

a closed-loop ion emitting slit formed in said cathode in the path of said magnetoconductive circuit, said closed-loop ion emitting slit having predetermined geometric dimensions defined by an inner profile and an outer profile;

electric power supply means for maintaining said anode under a positive charge and said cathode under a negative charge with respect to said anode;

means for the supply of a working medium into said hollow housing of said cathode to form an ion beam when said working medium passes through said ionization gap, said beam having a direction of propagation towards said object; and means for adjusting said predetermined geometric dimensions of said closed-loop ion emitting slit and thus for adjusting performance characteristics of said ion beam source, said cathode having a stationary part and a moveable part, said means for adjusting said predetermined geometric dimensions of said closed-loop ion emitting slit comprising means for moving said moveable part of said cathode with respect to said stationary part of said cathode.

2. The ion beam source of claim 1, wherein one of said predetermined geometric dimensions is the width of said closed-loop ion emitting slit and wherein said moveable part of said cathode defines said width and is moveable in the direction perpendicular to said direction of propagation of said ion beam.

3. The ion beam source of claim 2, wherein said moveable part of said cathode consists of two members that define two opposite sides of said closed-loop ion emitting slit and that are moveable simultaneously and in mutually opposite directions.

4. The ion beam source of claim 3, wherein said magnetic field generating means is at least one permanent magnet.

5. The ion beam source of claim 4, wherein said closed-loop ion emitting slit has a shape selected from a group consisting of rectangular, circular, oval, and elliptic shapes.

6. The ion beam source of claim 1, wherein said means for adjusting has a first part connected to said moveable pan of said cathode and a second part that extends outside said hollow housing through sealing means for controlling movements of said moveable part of said cathode from outside of said universal ion beam source.

7. The ion beam source of claim 1, wherein said means for adjusting is at least one screw having a round head freely rotating in a recess formed in said moveable part of said cathode and a threaded portion engageable with a threaded opening in a part stationary with respect to said moveable part of said cathode.

8. The ion beam source of claim 1, wherein said hollow housing has guides for guiding said moveable part in said direction of propagation of said beam towards said object.

9. The ion beam source of claim 8, wherein said moveable part of said cathode is a central part of said cathode which defines said inner profile of said ion-emitting slit.

10. The ion beam source of claim 9, wherein said magnetic field generating means is at least one permanent magnet.

11. The ion beam source of claim 10, wherein said closed-loop ion emitting slit has a shape selected from a group consisting of rectangular, circular, oval, and elliptic shapes.

12. The ion beam source of claim 11, wherein said magnetic field generating means is connected to said moveable part of said cathode for moving integrally therewith.

13. The ion beam source of claim 12, wherein said means for adjusting has a first part connected to said moveable part of said cathode and a second part that extends outside said hollow housing through sealing means for controlling movements of said moveable part of said cathode from outside of said universal ion beam source.

14. The ion beam source of claim 13, wherein said hollow housing has a guide portion, said guide portion containing a guide member which is connected to said permanent magnet, and said means for adjusting being made in the form of at least one screw having a round head freely rotating in a recess formed in said second part and a threaded portion engageable with a threaded opening in a part stationary with respect to said moveable part.

15. A method for adjusting performance characteristics of an ion beam source with a closed-loop ion emitting slit of predetermined geometric dimensions, comprising the steps of:

providing said ion-beam source with means for adjusting said predetermined geometric dimensions of said closed-loop ion emitting slit; and adjusting performance characteristics of said ion beam by changing said predetermined geometric dimensions of said closed-loop ion emitting slit, said step of adjustment being performed by adjusting the width of said closed-loop ion emitting slit, said ion beam source having a cathode comprising a stationary part and a moveable part, said adjustment being performed by moving said moveable part of said cathode in the direction perpendicular to the direction of propagation of said ion beam.

16. A method for adjusting performance characteristics of an ion beam source with a closed-loop ion emitting slit of predetermined geometric dimensions, comprising the steps of:

providing said ion-beam source with means For adjusting said predetermined geometric dimensions of said closed-loop ion emitting slit; and adjusting performance characteristics of said ion beam by changing said predetermined geometric dimensions of said closed-loop ion emitting slit, said step of adjustment being performed by adjusting the width of said closed-loop ion emitting slit, said ion beam source having a cathode comprising a stationary part and a moveable part, said adjustment is performed by moving said moveable part of said cathode in the direction of propagation of said ion beam.

17. A method for adjusting performance characteristics of ion beam source with a closed-loop ion emitting slit of predetermined geometric dimensions, comprising the steps of:

providing said ion-beam source with means for adjusting said predetermined geometric dimensions of said closed-loop ion emitting slit;

generating an ion beam by means of said ion beam source;

directing said ion beam onto the surface of an object to be treated;

observing the shape of said ion beam and its location with respect to said surface of said object; and adjusting performance characteristics of said ion beam by changing said predetermined geometric dimensions of said closed-loop ion emitting slit while observing said shape and location of said ion beam, said step of adjustment being performed by adjusting the width of said closed-loop ion emitting slit; said ion beam source having a cathode comprising a stationary part and a moveable part, said adjustment being performed by moving said moveable part of said cathode in the direction perpendicular to the direction of propagation of said ion beam.

18. A method for adjusting performance characteristics of ion beam source with a closed-loop ion emitting slit of predetermined geometric dimensions, comprising the steps of:

providing said ion-beam source with means for adjusting said predetermined geometric dimensions of said closed-loop ion emitting slit;

generating an ion beam by means of said ion beam source;

directing said ion beam onto the surface of an object to be treated;

observing the shape of said ion beam and its location with respect to said surface of said object; and adjusting performance characteristics of said ion beam by changing said predetermined geometric dimensions of said closed-loop ion emitting slit while observing said shape and location of said ion beam, said step of adjustment being performed by adjusting the width of said closed-loop ion emitting slit, said ion beam source having a cathode comprising a stationary part and a moveable part, said adjustment being performed by moving said moveable part of said cathode in the direction of propagation of said ion beam.

* * * * *